US007322760B2

(12) United States Patent
Campanini

(10) Patent No.: US 7,322,760 B2
(45) Date of Patent: Jan. 29, 2008

(54) ANTIJAMMING DEVICE FOR PRINTERS PUT IN PUBLIC PLACES

(75) Inventor: Alberto Campanini, Fidenza (IT)

(73) Assignee: Custom Engineering Spa, Fontevivo (Parma) (IT)

( * ) Notice: Subject to any disclaimer, the term of this patent is extended or adjusted under 35 U.S.C. 154(b) by 35 days.

(21) Appl. No.: 11/193,214

(22) Filed: Jul. 29, 2005

(65) Prior Publication Data

US 2006/0147241 A1 Jul. 6, 2006

(51) Int. Cl.
*B41J 11/00* (2006.01)
*B65H 23/18* (2006.01)
*B65H 20/00* (2006.01)

(52) U.S. Cl. ..... 400/611; 400/366; 400/425; 399/396; 226/29; 226/30; 226/122; 226/178

(58) Field of Classification Search ..... 399/29, 399/396; 400/366, 425, 624, 611; 271/270; 226/29, 30, 122, 178
See application file for complete search history.

(56) References Cited

U.S. PATENT DOCUMENTS 3,863,913 A * 2/1975 Hirafuji ..... 271/265.02
3,894,669 A * 7/1975 Wescoat ..... 225/103
4,025,187 A * 5/1977 Taylor et al. ..... 399/394
4,116,127 A * 9/1978 McInerny ..... 101/232
4,353,274 A * 10/1982 Shimizu ..... 83/156
4,806,970 A * 2/1989 Nakatomi et al. ..... 399/122
4,951,090 A * 8/1990 Matsumoto et al. ..... 399/13
6,056,460 A * 5/2000 Suzuki ..... 400/621
6,428,226 B1 * 8/2002 Suzuki et al. ..... 400/642
6,564,025 B2 * 5/2003 Sameshima et al. ..... 399/68
6,904,843 B2 * 6/2005 Knobel ..... 101/228
7,251,426 B2 * 7/2007 Koshida ..... 399/68
2002/0063384 A1 * 5/2002 Quesnel ..... 271/270

FOREIGN PATENT DOCUMENTS

EP 0 641 664 A2 3/1995

* cited by examiner

*Primary Examiner*—Ren Yan
*Assistant Examiner*—Matthew Marini
(74) *Attorney, Agent, or Firm*—J. Harold Nissen; Lackenbach Siegel, LLP

(57) ABSTRACT

An antijamming device for a printed ticket vending machine having an exit opening for exiting of a printed ticket and a control for controlling feeding of unprinted tickets to a printing mechanism for printing tickets, having a pathway through which printed tickets pass from the printing mechanism to the exit opening, and a sensor in the pathway for sensing when an occlusion occurs at the exit opening to prevent bunching of the printed tickets at the exit opening and stopping feeding of printed tickets to the exit opening.

18 Claims, 5 Drawing Sheets

ANTIJAMMING DEVICE FOR PRINTERS PUT IN PUBLIC PLACES

BACKGROUND OF THE INVENTION

1. Field of the Invention

This invention is concerned with an anti-jamming device for a ticket vending machine containing a printer. More particularly, the invention is concerned with ticket vending machines containing printers placed or located in public places which places may be subjected to vandalism, actually or playfully.

2. Description of the Prior Act

It is well known that machines which distribute tickets, such as vending machines or machines for dispensing a ticket or memorandum determining time of arrival for service, may be damaged due to accidental causes or vandalism.

Machines of this type also generally contain printers to print tickets or other memoranda containing pertinent or usable information, which tickets can be purchased, for example, at a theater and after the tickets are purchased the machines print the tickets, or the provision of usable information to determine when an individual should be serviced.

General components of these vending machines might, in some instances, be provided with a printer unit and paper cutting devices to cut a paper from a paper ticket roll to form a ticket which is dispensed from a roll, placed inside the vending machine. Accordingly, a ticket or paper printer and a cutting mechanism are presented in succession or in series with one another, and the paper generally is dispensed from the paper roll which is set and moved by rollers conventionally driven by electric motors or other suitable means towards the machine exit for the paper or ticket at which point the user obtains the ticket or paper or a stamp, if a stamp is being dispensed.

In the prior art, devices are known which are intended to avoid a pull or dragging of the paper from the roll in an excessive or undesirable manner. These devices generally place the paper on channelings or grooves with an angulated route having a curved inner portion or configuration and a cutting blade so to have the paper cut when the paper is pulled and placed into tension onto the blade from a pulling action actuated by the machine user.

These current systems, therefore, only provide means to cut the paper ticket at the exit after the paper is fed or pulled through the exit, and once the paper/ticket is pulled so as to avoid an unrolling of the paper roll placed inside the machine.

When a printed ticket is involved to provide a unique ticket for an individual, it is important that the ticket not be mutilated or destroyed. In order to overcome the aforesaid problems, the proposed improvement for these vending machines provides for a novel proposal that prevents a jamming of the vending machines or printers which are placed in public places owing to an occlusion or transversal disposition of the paper or a blockage of the paper. In fact, it is noted that a greater part of the upkeep actions or requirements of these machines is due to the fact that the paper for various reasons and causes becomes jammed near the distributing exit of the vending machine. Moreover, the paper forming the new exiting ticket is pushed and activated by an electric motor which operates a roll at the exit end with the paper already jammed which results in a consequent blocking of the vending machine. In the printer art, generally, a vending machine distributes tickets and generally includes a printer unit and a cutting unit. Inside the machine, a paper capstan or drive roll is driven by an electric motor. The capstan or roll is a paper holder. In some versions of the paper movement moved from rolls, the paper movement is accomplished by connecting the paper rolls to the electric motor, and the electric motor determines and substantially controls the advancement of the paper from the paper capstan or reel. The paper is then driven inside a conventional duct towards an exit or paper exit opening.

SUMMARY OF THE INVENTION

In accordance with the teachings of this invention, a rise and a sensor is provided inside a ticket pathway or duct to assist in the prevention of jamming of the ticket at the exit opening.

Accordingly, this invention proposes an antijamming device for a printed ticket vending machine having an exit opening for exiting of a printed ticket and a control for controlling feeding of paper to a printing mechanism for printing tickets passing through a pathway through which printed tickets pass from the printing mechanism to the exit opening, and the control includes a sensor in the pathway for sensing when an occlusion occurs at the exit opening to prevent bunching of the printed tickets at the exit opening and stopping feeding of printed tickets to the exit opening.

To these ends, the present invention proposes the use of a vending machine having the aforesaid antijamming device for a printer placed into a public place, which vending machine includes a printer and an exit opening for permitting paper to exit from the vending machine. A paper ticket roll is provided which has a leading end fed through the duct leading to the exit opening for the exiting of paper, the control is provided in the duct for controlling the exit of paper in order to prevent jamming of the paper at the exit opening, and the control is responsive to the occlusion at the exit opening to prevent further movement of the paper towards the exit opening.

One of the controls provided in connection with the rise includes a spring microswitch connected with a mechanism for controlling movement of the paper and responsive to paper backing up at the exit opening due to an occlusion.

A further feature is the positioning of the microswitch within the duct.

An important feature of the invention includes the rise in the duct and the cooperation with the microswitch which is associated with the rise so that as paper becomes occluded at the exit opening, the rise causes paper backed-up at the rise to activate the microswitch and to deactivate or prevent any further movement of paper from entering into the duct.

The control for permitting movement of the paper reactivates the movement of the paper when the occlusion at the exit has been removed.

In another embodiment, the control includes a door or movable member which is actuated by the paper moving the door to deactivate the paper drive for stopping the movement of the paper, and a pair of contacts associated with the paper movement control such that one of the contacts is responsive to the door for stopping the paper movement control, and the other of the contacts is associated with the paper movement control after the occlusion has been removed to restart the paper drive and continue the paper movement. A specific feature is that the movable member is pivotally arranged to cooperate with electrical contacts.

A further feature of the control is the provision of a sensor juxtaposed to the rise for activating and deactivating the paper movement control responsive to an occlusion at the paper exit opening.

The control includes a sensor and a microswitch juxtaposed to the rise to control the paper control and thereby the advancement of the paper.

The control includes a movable sensing device responsive to increased accumulation of paper and a pre-selected area within the printing machine after there is a buildup of paper or ticket forming material accumulating at the pre-selected area.

In one embodiment, the sensor includes a rise in the duct and a microswitch responsive to and activation thereof in response to a backing-up of printed tickets at thee rise for deactivating the feeding of paper to the printing mechanism.

In another embodiment, the sensor includes a rise in the duct and a contact movable arm for opening and closing a pair of contacts for deactivating the feeding of paper to the printer mechanism when the contact movable arm is moved from one position connecting the pair of contacts to another position for disconnecting of the pair of contacts in response to an occlusion occurring at the exit opening and a back-up of ticket occurring at the rise.

The vending machine includes paper movement apparatus to move paper in the vending machine through the pathway to said exit opening, and the control includes the rise and the sensor in the pathway for controlling the exit of paper to prevent jamming of paper at the exit opening, and the control is responsive to occlusion of paper at the exit opening to prevent further movement of the paper towards the exit opening and rendering the feed means inoperable. The paper movement apparatus includes an electric motor and connectors coupled with the control to control operation of the motor for starting and stopping of the motor. And, in one embodiment, the control includes the spring microswitch connected with the paper movement apparatus and responsive to paper backing up at the exit opening due to the occlusion for stopping the paper movement apparatus.

A further feature is the positioning of the microswitch within the pathway.

More specifically, the control includes the rise and the duct forming part of the pathway and the microswitch associated with the rise such that as paper becomes occluded at the exit opening, the rise causes paper backed-up at the rise to activate the microswitch and to deactivate the paper movement apparatus and to prevent additional paper from moving through the pathway to enter into the duct or paper pathway.

Reactivation of the paper movement apparatus for reactivating the movement of the paper when the occlusion has been removed is provided.

In another embodiment, the control includes a door or pivotally hinged member actuated by the paper for stopping paper movement apparatus, and a pair of contacts associated with the paper movement apparatus, the contacts being engageable and disengageable in response to the door or pivotally hinged member for starting and stopping the paper movement apparatus, depending upon absence or presence of an occlusion. The sensor is juxtaposed to the rise for activating and deactivating the paper movement apparatus responsive to the occlusion at the paper exit opening.

The sensor and a microswitch in one embodiment are juxtaposed to the rise to control the paper movement apparatus and thereby the advancement of the paper.

In another embodiment, the sensor includes a movable sensing device responsive to increased accumulation of paper at a pre-selected area within the printing machine after there is a buildup of paper accumulating at the pre-selected area.

It is, therefore, an object of this invention to provide for an antijamming device for a printer placed at public places having a duct to guide paper to an exit from the printer, a rise having, in the part where the paper is to be raised responsive to an accumulation of paper and the rise caused by an occlusion at the exit, the control being juxtaposed to the rise and connected through cables and connectors to an electric motor and apparatuses for movement of the paper, for temporarily stopping advancement of the paper when the paper pushes towards the control means owing to the occlusion at the exit.

Another object is to provide a control which includes a microswitch actuated by accumulation of paper at the rise to cut-off or disable the electric motor.

A further object is to provide a control that includes a door or pivotally hinged member proximate to the rise movable from a first position to enable the motor to operate, to a second position to disenable the motor and prevent further feeding of the paper.

The control means includes the rise in the duct and the door or pivotally hinged member associated with a pair of contacts to be disengaged from each other with the raising of the pivotally hinged member responsive to accumulation of paper at said rise to temporarily stop the motor and movement of paper, the contacts determining stopping or starting of the electric motor.

When a microswitch is used, it is placed near the rise and suitably connected to the motor with moving devices of the paper and to stop the paper running if the same paper is raised by the rise owing to an occlusion at the exit.

BRIEF DESCRIPTION OF THE DRAWINGS

FIG. 5 in particular shows the FIGS. 1 and 2 embodiment in one position, the free flow of paper normally free of any occlusion or blockage in the first embodiment at the exit opening, and illustrates the microswitch in its position to permit the free flow of the paper;

FIG. 6 in particular shows the FIGS. 3 and 4 embodiments in the FIG. 4 position and illustrates the door for the second embodiment in its raised or open position with the paper opening or moving the door away from the contact permitting free flow of the paper and upon the door moving to its open position, movement of the paper ticket is stopped; and FIG. 7 shows in detail the microswitch of the FIGS. 1 and 2 embodiments activated by the paper, in the second or FIG. 2 position of the first embodiment above the rise responsive to an occlusion or blockage at the exit opening to stop the movement of the paper.

LIST OF REFERENCE NUMERALS

Figure 1:
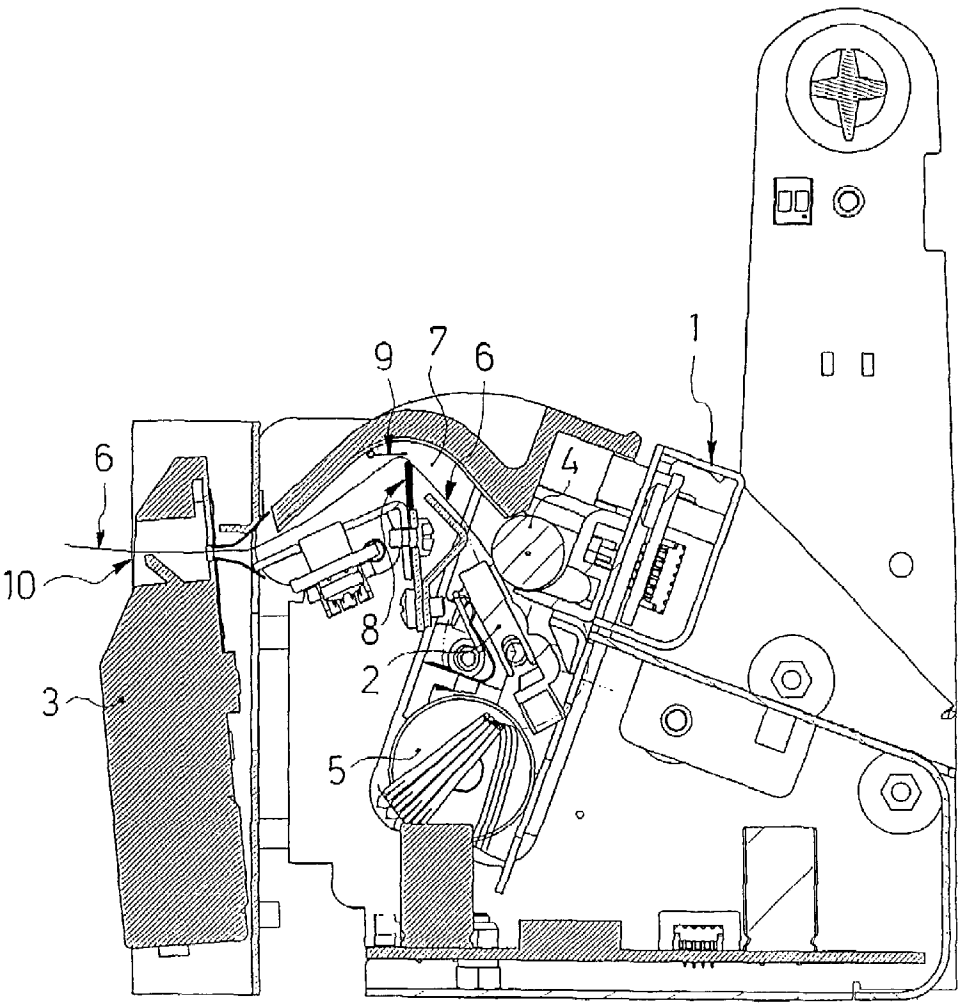
FIG. 1 is a sectional view of one embodiment of the invention with the rise illustrating the normal operative position of the ticket-issuing vending machine and illustrating a rise and a microswitch in one position in a non-occluded or non-blocked position according to the invention.

1. machine
2. printer unit
3. cutting unit
4. paper capstan or roll
5. electric motor
6. paper
7. duct forming part of ticket pathway
8. rise
9. spring microswitch
9A. movable door or contact arm or pivotally hinged member
9B. first contact
9C. second contact
10. exit opening

DESCRIPTION OF THE PREFERRED EMBODIMENTS

Figure 2:
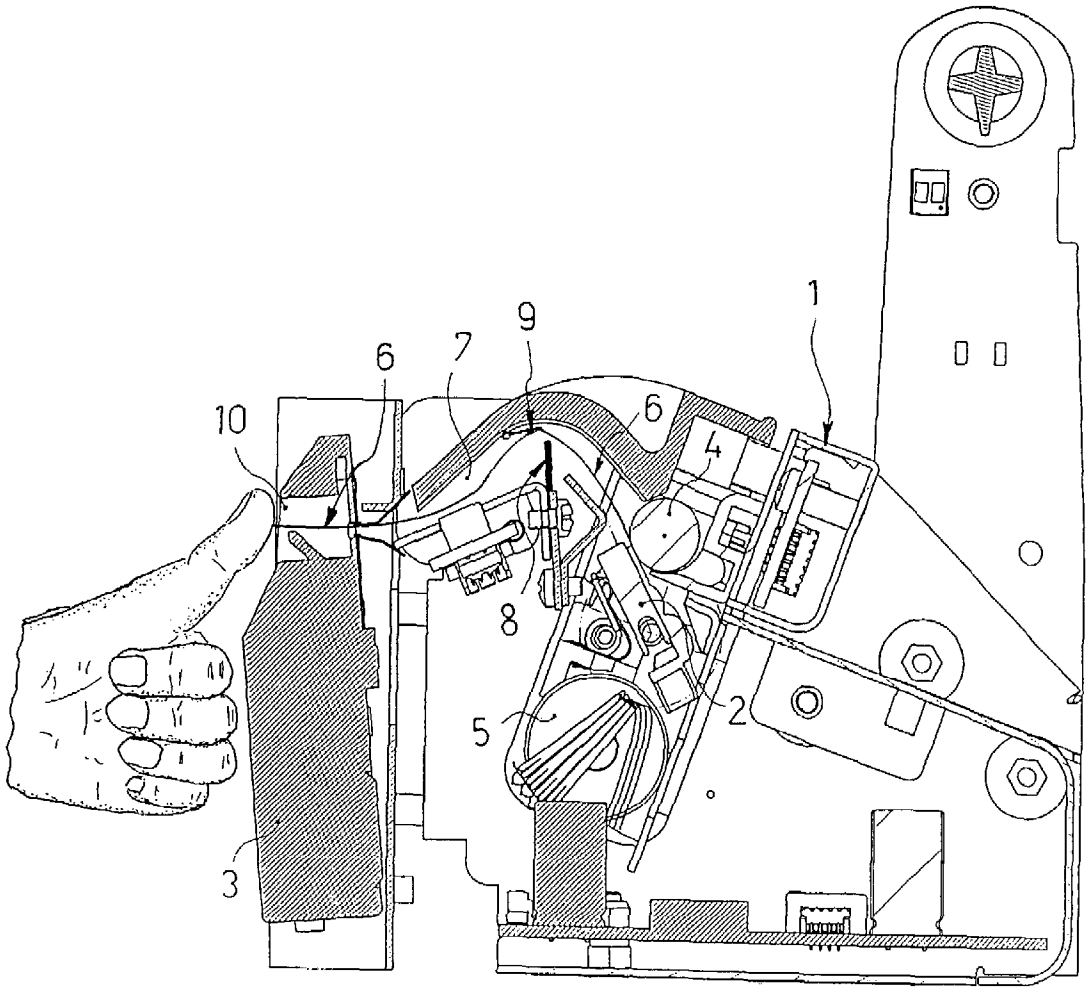
FIG. 2 is another sectional view of the FIG. 1 embodiment with the exit portion of the machine closed by a finger of a user and illustrating an occluded or blocked exit and the paper in its occluded position and the microswitch in its raised position.

Referring now more particularly to the drawings and more particularly to FIGS. 1 and 2 of the drawings, a typical vending machine having an internal ticket printing and dispensing arrangement 1 is shown, which illustrate the first embodiment having a microswitch 9 associated with a rise 8.

With respect to the first embodiment illustrated in FIGS. 1, 2, 5 and 7, ticket vending machine 1 contains a conventional printing unit 2 for printing onto paper 6 fed from a paper capstan or supply roll 4 to the printing unit 2. Paper 6 is driven by an electric motor or other paper drive mechanism, and paper 6, after being printed thereon, is fed through a duct 7 to an exit opening 10, and paper 6 exits through exit opening 10 provided with a conventional cutting unit 3.

Figure 7:
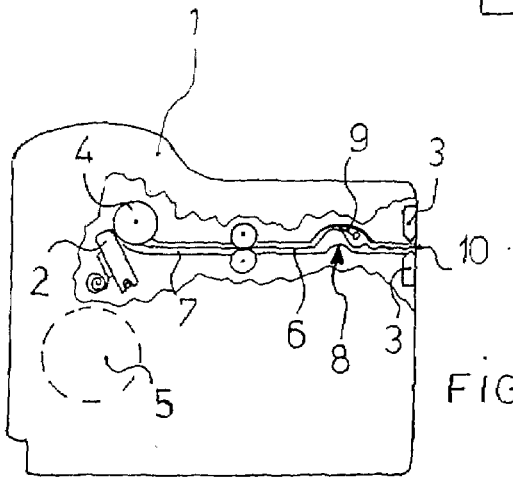

Positioned within duct 7 is the microswitch 9 and rise 8 juxtaposed thereto over which the paper passes, and should an occlusion or blockage occur at exit opening 10, the paper backs up at the rise 8. Positioned within duct 7 juxtaposed to rise 8 is spring mounted microswitch 9 which when activated or caused to be raised because of the blockage due to accumulation of paper above rise 8. Microswitch 9 is connected by conventional wiring to electric motor 5 which is cut-off or disabled and the feed of paper 6 is discontinued when an occlusion occurs because the paper accumulated at rise 8 and microswitch 9 is moved and activated to cut-off power to the electric motor 5. Conventional electrical wire couples motor 5 and microswitch 9 although other activation means may be used. As best seen in FIGS. 1 and 2, the pathway in duct 7 is open to permit paper to pass therethrough. As best seen in FIGS. 2 and 7, paper accumulates above rise 8, and microswitch 9 is activated or moved by the accumulation of paper to cut-off motor 5 and curtail any further feed of paper 6.

Figure 3:
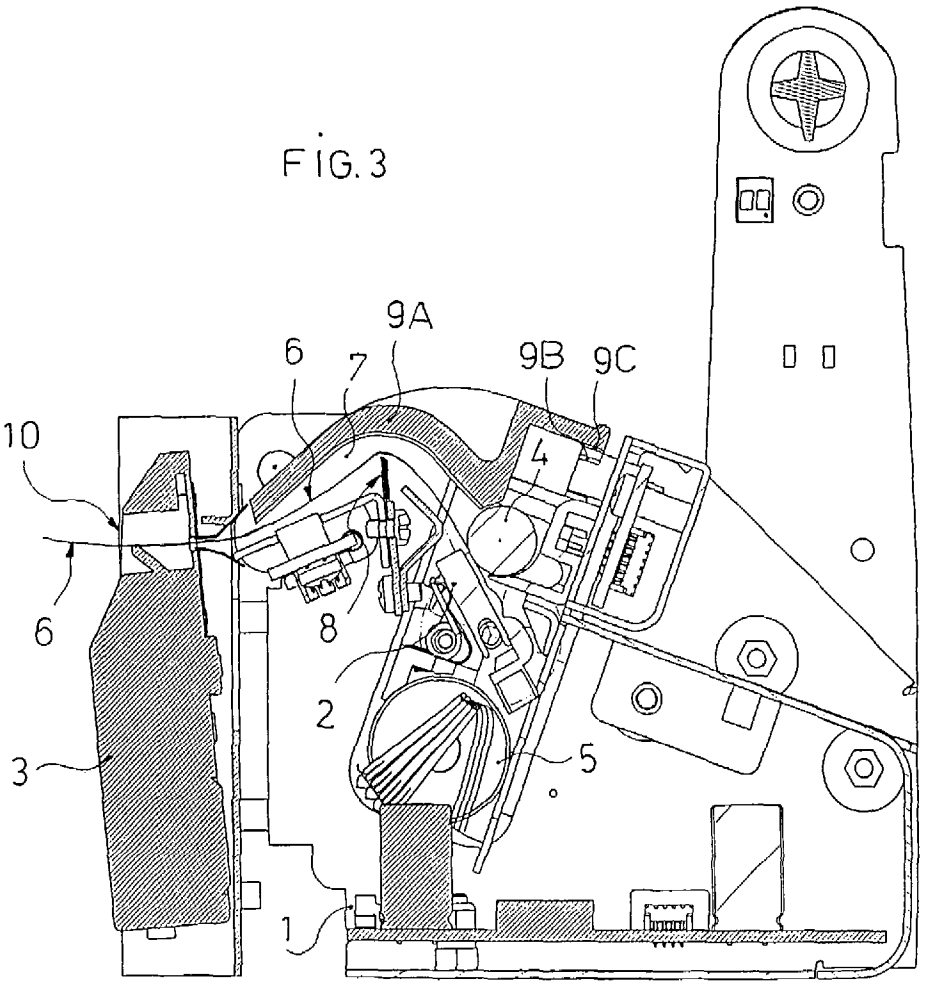
FIG. 3 is a sectional view of another embodiment of the invention similar in many respects to FIG. 1, and illustrating the rise and a door mechanism in its normal or ticket issuing operative position to permit the free flow of the paper ticket through the printing machine to exit through the exit opening.
Figure 4:
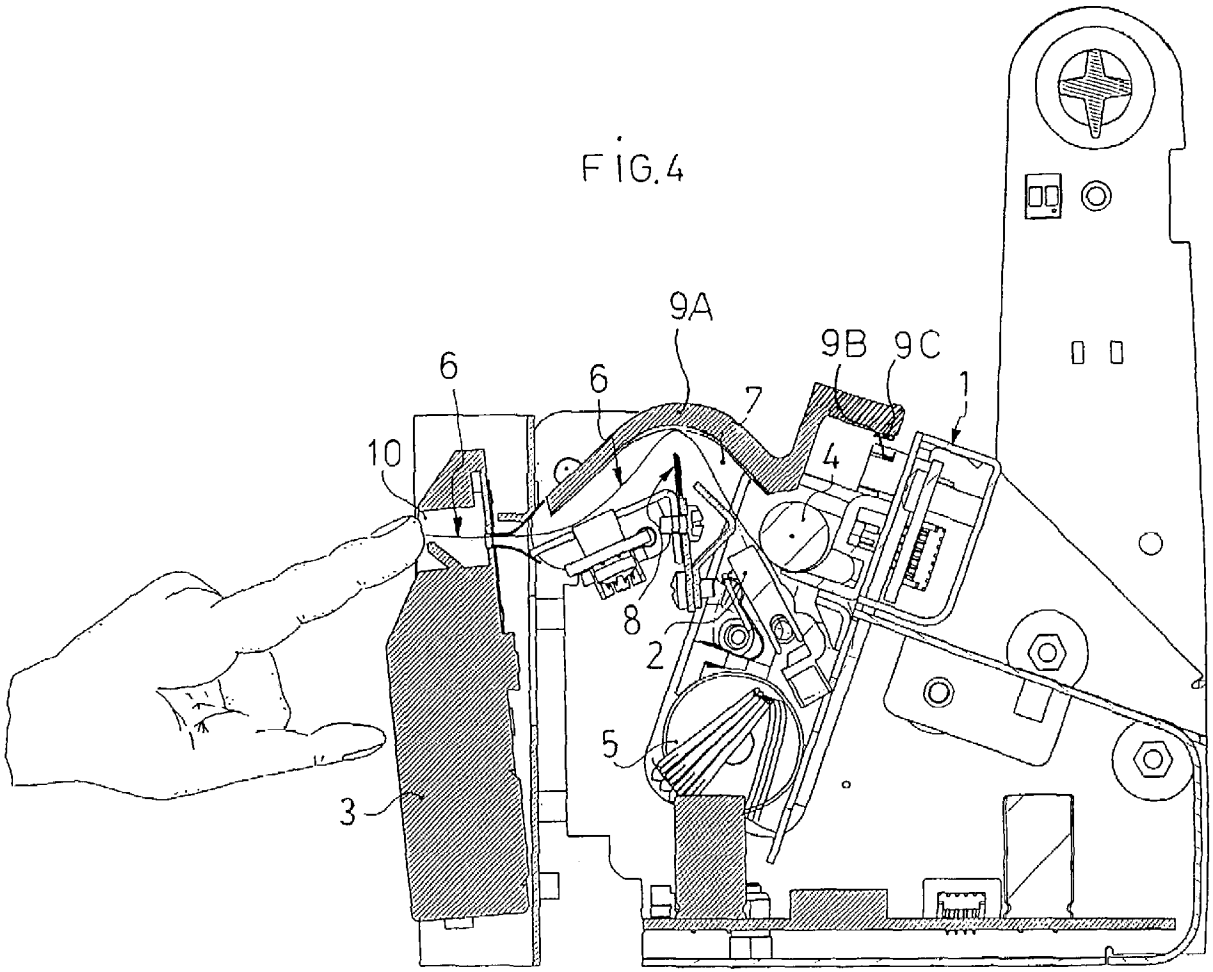
FIG. 4 is another sectional view of the FIG. 3 embodiment similar to FIG. 2 of the drawings but showing the rise and the door mechanism of FIG. 3 in its position to prevent the advancement of paper through the exit opening in response to an occlusion or other blockage at the exit opening.
Figure 5:
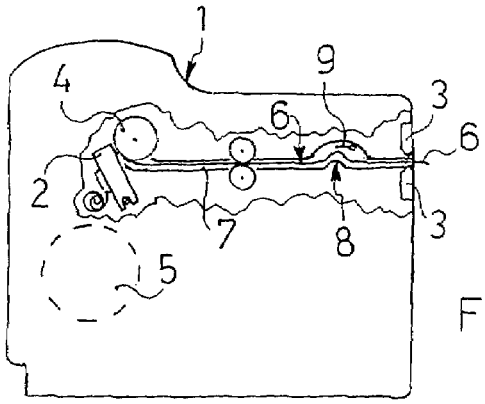
FIGS. 5 to 7 each illustrate schematic flow diagrams, each respectively illustrating schematically paper as it moves through the vending machine and past the printer from a supply roller to the exit opening.
Figure 6:
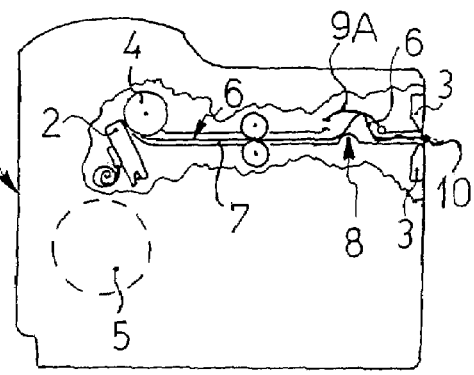

Referring now more particularly to the second embodiment illustrated in FIGS. 3, 4 and 6, the elements with the same reference numerals are in common and are the same as referred to in the FIGS. 1, 2, 5 and 7 embodiment.

In the second embodiment, a door or contact arm or pivotally hinged member 9A and two contacts, 9B and 9C, are provided. Door 9A is movable between two positions so that it can be raised from a first position in which contacts 9B and 9C are engaged or closed as best seen in FIG. 3 to a second or open position in which contacts 9B and 9C are disengaged as shown in FIGS. 4 and 6. In this second embodiment, as in the FIGS. 1 and 2 embodiment, once door 9A is raised because of the blockage at rise 8, and the accumulation of paper above rise 8, motor 5 is de-energized and paper is prevented from being moved towards the exit opening 10. When door 9A is in its closed condition with contacts 9B and 9C engaged or electrically coupled with each other, motor 5 is energized to move paper 6, and when door 9A is raised to disengage contacts 9B and 9C electrically, motor 5 is de-energized and paper 6 is prevented from being fed through the paper or ticket feed pathway into duct 7.

Description of Operation

Positioned within the duct 7 and proximate to the rise 8 is the pivotally arranged spring microswitch 9 which is connected through cables and connectors to the electric motor 5 or to an equivalent control device. When microswitch 9 is raised in response to the paper 6 being prevented from exiting through exit 10 and bunching together in duct 7, the microswitch 9 operates to disengage the motor and prevent its operation to temporarily stop the electric motor or the paper advancement component:

The printed ticket in the first embodiment exits from vending machine 1 passing through exit 10. When an occlusion or blockage of the exit 10 occurs or any other problem prevents the normal running or movement of paper 6, paper 6 in response to a partial occlusion by rise 8 is raised at this point pressing against microswitch 9 and causing it, after a certain amount of occlusion has been reached, to de-energize motor 5 and prevent paper feed.

The rise 8 acts as a blockage in duct 7 to prevent the paper from moving backwards through duct 7 to the printer and the bunching of the paper between rise 8 and exit 10 activates microswitch 9.

Put into action by the paper, microswitch 9 is able to temporarily stop motor 5 and the paper advancement components 6 so as to avoid an accumulation of the paper inside machine 1 and, consequently, a jamming of the same machine. When the occlusion or the problem for running of paper 6 toward exit 10 is superated or removed, vending machine 1 begins again its normal operating conditions.

It is to be noted that in many of situations or cases of intervention which results in jammings of these vending machines, the cause is due to temporary occlusions or blockages determined by a user's hand, for example, that closes exit 10 of machine 1, or to paper transversally placed in parts near the exit. Other causes are determined by acts of vandalism, such as chewing-gum or other objects inserted inside exit 10. In these cases, when a user uses their hand at exit 10 of the vending machine to remove the obstruction, or with small movements paper 6 to realign the paper the machine is again rendered operative, and to exit 10 or the obstruction to the machine at the exit is removed, and the machine is permitted its normal running of the paper, machine 1 begins again its normal working without necessity or other working or upkeep so that the paper no longer presses against microswitch 9.

In the second embodiment, which forms part of the same inventive concept, spring microswitch 9 is replaced by door or pivotally hinged member 9A, having a weight capable of and suitable of being raised by paper 6 and second contact 9C associated with door or pivotally hinged member 9A is moved out of contact with or disconnected from first contact 9B and the circuitry to motor 5 is opened to stop the motor and supply of paper. When the door or pivotally hinged member 9A is closed, contacts 9B and 9C are connected or joined, and the feed to electric motor 5 is completed to cause the electric motor 5 to operate and feed paper 6.

Therefore, opening of door or pivotally hinged member 9A stops the advancement of the paper 6 when the exit 10 is occluded on blocked as a result of a bunching together of the paper which causes the paper to be raised above the rise against the door, in much the same manner as in the first embodiment with the raising of the paper associated with the rise 8 that causes a raising of door or pivotally hinged member 9A. Also, in the second embodiment, when the occlusion or blockage is removed or it is finished, the invented device permits the normal working with automatic restarting of the systems for the advancement of paper 6 in much the same manner as the microswitch 9 and door or pivotally hinged member 9A is again restored to its original position, and since the occlusion is not present, the push or movement action of the paper resumes, motor 5 is again operative to cause the movement of paper in working conditions.

The invention thereby avoids costs to replace a vending machine into service to replace a disabled vending machine, and the labor costs due to servicing assistance necessary to eliminate the jammings noted in the above cited causes. Moreover, the jammings, in addition to preventing the machine from operating properly, such jammings can cause important damages to the same machine if the request of ticket emission is repeated and dissatisfied users.

Further, electric motor 5, in fact, can be damaged due to its being blocked during its advancement phase.

While there has been shown what is considered to be the presently preferred embodiments of the invention, various changes and modifications may be made without departing from the scope of the invention.

The invention claimed is:

1. An antijamming device for a printed ticket vending machine having an exit opening for exiting of a printed ticket and control means including a motor for controlling feeding of paper from a paper roll to a printing mechanism for printing tickets, comprising: a pathway including a duct through which the paper moves through which said ducts printed tickets pass from said printing mechanism to said exit opening; a sensing means including a rise positioned within said duct and a contact movable arm in said duct movable between a pair of contacts for deactivating the feeding of paper from said roll to said printer mechanism when said rise causes paper to engage and contact said contact movable arm when said occlusion occurs to cause said contact movable arm to move from one position connecting said pair of contacts to another position for disconnecting of said pair of contacts in response to the occlusion occurring at the exit opening and a back-up of printed tickets occurring at said rise to stop the motor from feeding paper from said paper roll when an occlusion occurs; said control means including said sensing means located within said pathway for sensing when the occlusion occurs at said exit opening solely to prevent bunching of the printed tickets at said exit opening and stopping feeding of the printed tickets to said exit opening; and said rise including a protrusion integrally formed in said pathway positioned perpendicular to the feeding direction of the paper and opposingly to said contact movable arm as to cause the paper to bend around said rise.

2. The antijamming device as claimed in claim 1, wherein said sensing means includes said rise, located within said duct and said microswitch also located within said duct, said microswitch being responsive to the occlusion and activation of said microswitch being in response to a backing-up of printed tickets at said rise due to said occlusion for deactivating the feeding of paper to said printing mechanism.

3. The antijamming device, as claimed in claim 1, including:

paper movement means to move paper in said vending machine through said pathway to said exit opening;

said control means, including said rise and said contact movable arm, in said pathway for controlling the exit of paper to prevent jamming of paper at said exit opening; and said control means being responsive to occlusion of paper at said exit opening to prevent further movement of the paper towards said exit opening and rendering said feed means inoperable.

4. The antijamming device as claimed in claim 1, wherein said paper movement means includes an electric motor and connectors coupled with said control means to control operation of said electric motor for starting said electric motor to move paper through said duct and stopping of said electric motor to prevent paper from moving in said duct.

5. The antijamming device as claimed in claim 1, wherein said contact movable arm includes a spring microswitch connected with paper movement means and responsive to paper backing up at said exit opening due to said occlusion for stopping said paper movement means.

6. The antijamming device, as claimed in claim 5, wherein said microswitch is positioned within said pathway for direct contact with the paper as the paper moves through the pathway when the occlusion occurs.

7. The antijamming device as claimed in claim 1, wherein said rise and said duct form part of said pathway and a mechanical microswitch associated with said rise such that as paper becomes occluded at said exit opening, said rise causes the paper as it moves from said roll through the pathway backed-up at said rise to activate said microswitch and to deactivate paper movement means and prevent additional paper from moving through said pathway to enter into said duct.

8. The antijamming device as claimed in claim 1, wherein said paper movement means reactivates the movement of the paper when the occlusion has been removed.

9. The antijamming device as claimed in claim 1, wherein said paper movement means includes said motor and said control means includes a door actuated by said paper for directly stopping said motor, and a pair of contacts associated with said paper movement means, said contacts being engageable and disengageable in response to said door for starting and stopping said motor, depending upon absence or presence of the occlusion.

10. The antijamming device as claimed in claim 1, wherein said sensing means includes a sensor within said pathway juxtaposed to said rise in said duct for activating and deactivating said paper movement means responsive to the occlusion at said paper exit opening and in response to said sensor making direct contact with the paper as the paper moves through the duct.

11. The antijamming device as claimed in claim 1, wherein said sensing means includes a sensor within said pathway and a microswitch in said duct juxtaposed to said rise to control paper movement means and thereby the advancement of the paper from said roll.

12. The antijamming device as claimed in claim 1, wherein said sensing means includes a movable sensing device responsive to increased accumulation of paper at a pre-selected area as a result of contact with the paper within said printing machine after there is a buildup of paper accumulating at said pre-selected area.

13. The antijamming device as claimed in claim 1, wherein said control means includes a door directly activated by said paper, said paper moving means includes said motor and a pair of contacts connected with said motor, said contacts being engageable and disengageable in response directly to said door for stopping and starting said motor, depending on the presence or absence of the occlusion.

14. An antijamming device for a printer placed at public places comprising:

a duct to guide paper to an exit from said printer, a sensing means including a rise positioned within said duct and a contact movable arm in said duct movable between a pair of contacts for deactivating the feeding of paper from said roll to said printer mechanism when said rise causes paper to engage and contact said contact movable arm when said occlusion occurs to cause said contact movable arm to move from one position connecting said pair of contacts to another position for disconnecting of said pair of contacts in response to the occlusion occurring at the exit opening and a back-up of printed tickets occurring at said rise to stop the motor from feeding paper from said paper roll when an occlusion occurs; said rise in said duct having, in the part where the paper is to be raised responsive to an accumulation of paper and said rise caused by an occlusion at said exit, said rise includes a protrusion integrally formed in said pathway positioned perpendicular to the feeding direction of the paper and opposingly to said contact movable arm as to cause the paper to bend around said rise; and control means including sensing means located in said duct juxtaposed to said rise connected through cables and connectors to an electric motor and apparatuses for movement of the paper, for temporarily stopping advancement of said paper when said paper pushes towards and contacts said control means directly owing to the occlusion at the exit.

15. The antijamming device as claimed in claim 14, wherein said control means includes a microswitch directly actuated by the paper in response to accumulation of paper at said rise to cut-off or disable said electric motor.

16. The device as claimed in claim 14, wherein said control means includes a door proximate to said rise movable from a first position to enable said motor to operate, to a second position to disenable said motor and prevent further feeding of the paper.

17. The device according to claim 14, wherein the control means includes said rise in said duct and a pivotally hinged member associated with a pair of contacts to be disengaged from each other with a raising of the pivotally hinged member responsive to accumulation of paper at said rise to temporarily stop the motor and movement of paper, said contacts determining stopping or starting of said electric motor.

18. The device as claimed in claim 14, wherein the control means includes a microswitch placed near the rise, with a sensor with the same connections to the motor with moving devices of the paper and to stop the paper running if the same paper is raised by the rise owing to an occlusion at the exit.

* * * * *